US006998015B2

(12) United States Patent
Hua et al.

(10) Patent No.: US 6,998,015 B2
(45) Date of Patent: Feb. 14, 2006

(54) METHOD FOR REDUCING ALKALINE DARKENING OF MECHANICAL PULP CONTAINING A CALCIUM CARBONATE FILLER

(75) Inventors: Xujun Hua, Kirkland (CA); Makhlouf Laleg, Pointe Claire (CA)

(73) Assignee: Pulp and Paper Research Institute of Canada, Pointe Claire (CA)

( * ) Notice: Subject to any disclaimer, the term of this patent is extended or adjusted under 35 U.S.C. 154(b) by 444 days.

(21) Appl. No.: 09/994,075

(22) Filed: Nov. 27, 2001

(65) Prior Publication Data

US 2002/0059999 A1 May 23, 2002

Related U.S. Application Data

(63) Continuation of application No. 09/417,085, filed on Oct. 13, 1999, now abandoned.

(60) Provisional application No. 60/105,951, filed on Oct. 28, 1998.

(51) Int. Cl.

| | |
|---|---|
| *D21C 3/04* | (2006.01) |
| *D21C 3/06* | (2006.01) |
| *D21C 3/12* | (2006.01) |
| *D21H 13/48* | (2006.01) |
| *D21H 11/06* | (2006.01) |

(52) U.S. Cl. ..... 162/83; 162/181.1; 162/181.2

(58) Field of Classification Search ..... 162/24, 162/25, 26, 83, 90, 158, 160, 162, 181.2, 162/181.3, 185; 3/111, 109, 110
See application file for complete search history.

(56) References Cited

U.S. PATENT DOCUMENTS

| | | | | |
|---|---|---|---|---|
| 2,173,167 | A * | 9/1939 | Hovey | 162/142 |
| 2,173,687 | A * | 9/1939 | Hovey | |
| 4,183,146 | A * | 1/1980 | Tsukamoto et al. | 134/30 |
| 4,427,490 | A * | 1/1984 | Eckert | 162/78 |
| H1690 | H * | 11/1997 | Nye | 162/72 |
| 5,882,476 | A * | 3/1999 | Evans et al. | 162/7 |

FOREIGN PATENT DOCUMENTS

| | | | |
|---|---|---|---|
| EP | 0 608 687 | * | 7/1994 |
| WO | 96/20308 | * | 7/1996 |

* cited by examiner

*Primary Examiner*—Dionne A. Walls
*Assistant Examiner*—Lisa L. Herring
(74) *Attorney, Agent, or Firm*—Ogilvy Renault LLP

(57) ABSTRACT

A method is disclosed for reducing or inhibiting alkaline darkening of mechanical pulp caused by the presence of calcium carbonate filler during production; the method comprises adding a sulfite, or sulfur-containing reducing agent, especially a sulfite to the mechanical pulp and the filler; the method is usefully applied in the production of mechanical pulp and paper in which calcium carbonate is used as a filler and also in the production of paper at neutral or mildly alkaline conditions.

15 Claims, 3 Drawing Sheets

METHOD FOR REDUCING ALKALINE DARKENING OF MECHANICAL PULP CONTAINING A CALCIUM CARBONATE FILLER

CROSS REFERENCE TO RELATED APPLICATION

This Application is a Continuation of U.S. Ser. No. 09/417,085 filed Oct. 13, 1999 now abandoned and claims priority under 35 U.S.C. 119(e) from U.S. Provisional Application Ser. No. 60/105,951, filed Oct. 28, 1998.

BACKGROUND OF THE INVENTION

1. Field of the Invention

This invention relates to a method and aqueous suspension for manufacturing a carbonate-containing mechanical pulp and paper at neutral or mildly alkaline conditions. More particularly, it relates to a method and suspension for preventing alkaline darkening of calcium carbonate containing mechanical pulps.

2. Description of Prior Art

Wood-free fine paper is mainly made from bleached chemical pulp and may contain as much as 20% or more of calcium carbonate filler. Producing wood-free fine paper with ground calcium carbonate (GCC) and precipitated calcium carbonate (PCC) filler yields significant advantages, both economical and in quality, over acid paper made with clay fillers. Converting from acid to alkaline papermaking enables the use of bright, low cost PCC since carbonate fillers are known to decompose in acid.

Today, many LWC (light weight-coated) and magazine paper mills are running under slightly alkaline conditions, pH 7.2–8.0. The LWC base sheet and magazine paper are made from bleached mechanical pulp and up to 50% chemical pulp, whereas some magazine papers are made from 100% recycled papers which contain up to 60% chemical pulp. The calcium carbonate filler comes from coated broke, from the recycled papers or is purposely added to the stock. The calcium carbonate enhances paper opacity and brightness, improves the printing properties of the paper, and reduces fiber cost.

Despite its many benefits $CaCO_3$ is not used in the production of regular newsprint and mechanical pulp printing grades for two reasons: pulp darkening, and the solubility of $CaCO_3$ in acidic media. If a solution to these drawbacks was found, high quality paper could be made from high-yield mechanical pulp stock, the opacity and brightness could be enhanced using PCC and, the cost of production could be substantially reduced.

A mechanical pulp has an acidic nature because it contains carboxylic and other acidic groups. Mechanical pulps lose brightness when exposed to alkaline environment. Since the pH of $CaCO_3$ suspension is between 8.2 and 10, the pulp will darken in its presence.

As a wet end filler, calcium carbonate is often added into the machine chest of the papermaking system. About 50% of the added calcium carbonate ends up in the whitewater and circulates in the paper machine system. In an integrated paper mill, this carbonate-containing whitewater circulates back to the pulping plant, thus increasing the pH in the pulping process (see FIG. 4). The temperature in mechanical pulping is usually much higher than in a papermaking system and can reach 150° C. in a refiner. A combination of alkaline pH and high temperature is known to have a more negative effect on pulp brightness.

Paper cannot be produced in an acidic medium using $CaCO_3$ as filler because $CaCO_3$ is soluble in such a medium, forming calcium ions and carbon dioxide gas. The lower the pH of the medium, the more $[Ca^{+2}]$ ions dissolve into solution. The solubility of calcium carbonate is also influenced by the level of electrolytes and dissolved acidic wood substances present in solution [Weigl, J. Papermaking problems with systems containing calcium carbonate at faintly acid or basic pH ranges. Wochbl. Papierfabr. 110: 857–866 (1982)].

In U.S. Pat. Nos. 5,043,017 and 5,505,819 methods are disclosed for using special combinations of acids to reduce the pH of calcium carbonate containing pulp to neutral without significantly dissolving the $CaCO_3$. Under neutral pH conditions the darkening of mechanical pulp is reduced. However, when used in the production of groundwood paper at neutral pH conditions (pH 6.5–7.5) a 1 to 5 point brightness loss is often experienced.

A method for reducing alkaline darkening of mechanical pulp due to the presence of a $CaCO_3$ filler is therefore necessary to achieve a successful conversion from acid to neutral/alkaline papermaking.

U.S. Pat. No. 2,173,167 teaches making high-brightness groundwood-containing paper by the addition of calcium carbonate filler. In the method pulp brightness loss caused by alkaline darkening was compensated by the addition of at least (10%) of calcium carbonate filler. In other words the effect of alkaline darkening was masked by increasing the level of calcium carbonate in the sheet. This method is not suitable for grades, such as newsprint, that employ only a few percent of carbonate. Even for papers that contain enough carbonate to overcome the pulp brightness loss, it would be desirable to minimize pulp darkening.

The use of some reducing agents is suggested to decrease light-induced brightness reversion of mechanical pulps. U.S. Pat. No. 5,080,754, for instance, teaches that the reduction of mechanical pulp yellowing can be achieved by using certain formyl compounds. Although in this patent it was also claimed that the reduction of the yellowing could be enhanced by adding calcium carbonate filler, the $CaCO_3$ was applied onto the paper surface, but not to the pulp stock. A method is disclosed in U.S. Pat. No. 5,181,988 for preventing light-induced paper yellowing using hypophosphorous acid and its salts. In U.S. Pat. No. 5,368,689, the use of reducing agents with specifically defined organic acid or its salt. In all these references, costly reducing agents are used to decrease brightness reversion caused by light exposure. These methods might reduce pulp darkening caused by the addition of calcium carbonate filler, but are too expensive.

Sodium sulphite is a cheap product commonly used in the production of: sulphite pulp, chemi-mechanical pulp and chemi-thermomechanical pulp. The sulphite is used to soften lignin in the wood fibre, to reduce refining energy, increase the long fibre fraction and to improve pulp strength. Although it is known that sodium sulphite applied in this manner leads to a brighter pulp; it is seldom used as a bleaching agent because of its low bleaching efficiency. Sodium sulphite is rapidly consumed at refiner or grinder temperatures and would not be useful in decreasing mechanical pulp darkening during subsequent paper making with calcium carbonate filler. Japanese patent J6 3190095 discloses a method using high yield pulp and calcium carbonate to produce lightweight coating base paper. As a part of a high yield pulping process, sodium sulphite is used in the cooking stage at a high dosage, over 8%, at a high temperature, 105–180° C., and at a neutral pH, before the subsequent refining. The purpose of sodium sulphite is to soften the wood chips and partially remove lignin. The sodium sulphite is consumed in the cooking stage and so it is not available to prevent alkaline darkening during papermaking with $CaCO_3$.

U.S. Pat. Nos. 2,178,606, 2,186,040 and 2,242,087 disclose the use of sulphurous acid in the production of filler from dolomitic limestone. The purpose of using sulphurous acid or acid calcium bisulphite is to dissolve the carbonate to remove the magnesium or regenerate the solid particles, or to dissolve portions of the filler particle to make the filler more opaque. Calcium and magnesium sulphites may also be precipitated out and become a part of the produced filler. This patent also claims that the presence of calcium and magnesium sulphite filler in paper produced from mechanical pulp tends to prevent light induced yellowing due to aging and exposure to sunlight.

U.S. Pat. No. 4,183,146 discloses a process for simultaneously drying mechanical pulp and improving its strength and brightness properties. In this process, sodium sulphite is added to a pulp having a solid content of 20 to 50%. The sulphonation and bleaching reactions take place at high temperatures and no mention is made of $CaCO_3$ being present as filler.

In summary, no prior teaching is known that addresses the reduction of alkaline darkening of mechanical pulp due to the presence of calcium carbonate filler during pulp or paper production.

SUMMARY OF THE INVENTION

It is an object of the present invention to provide a method that is useful for reducing or partially or completely preventing the darkening of mechanical pulps associated with the presence of calcium carbonate filler during neutral to mildly alkaline pulping and/or papermaking.

One significant advantage of the method of this invention is to enable successful conversion of acid to neutral/alkaline papermaking.

Another advantage of this invention is to provide a use of the method in the production of newsprint and mechanical pulp printing grades of paper using a calcium carbonate filler.

A further advantage of the method of this invention is its use in the production of high-brightness groundwood-containing paper containing calcium carbonate filler.

Yet another advantage of this invention is that it can be used to produce a sulphite chemi-mechanical and sulphite chemi-thermomechanical pulp containing calcium carbonate filler and not experience any pulp darkening effect during production.

In accordance with one aspect of the invention there is provided a method of inhibiting alkaline darkening of a mechanical pulp in the presence of a calcium carbonate filler comprising providing an aqueous suspension of a mechanical pulp for producing paper, and incorporating in said suspension a calcium carbonate filler for producing paper with the pulp, and a sulphite.

In accordance with another aspect of the invention there is provided a method of inhibiting alkaline darkening of a mechanical pulp in the presence of a calcium carbonate filler comprising adding a calcium carbonate filler and a sulphur-containing reducing agent to an aqueous suspension of a mechanical pulp, said reducing agent being effective to reduce quinones to hydroquinones in a mechanical pulp.

In still another aspect of the invention there is provided an aqueous paper manufacture suspension comprising: a mechanical pulp, a calcium carbonate filler and a sulphite in an aqueous vehicle said sulphite inhibiting alkaline darkening of said mechanical pulp.

DESCRIPTION OF THE INVENTION

It has now been found that the addition of sodium sulphite, sodium bisulphite or sodium meta-bisulphite to a slurry of mechanical pulp and calcium carbonate filler, at operating conditions at the latency chest, storage tank and during papermaking substantially reduces pulp darkening caused by the presence of the calcium carbonate filler. It has also been found that a mixture of sodium carbonate and any of these sulphites will help to further reduce the darkening of the pulp.

While it is not the intention to be bound by any particular theory regarding the mechanism of the present findings, it is believed that the sulphite inhibits auto-oxidation of hydroquinone in lignin to quinones which is the main factor that causes alkali darkening. The sulphite acts as a reducing agent and destroys the chromophoric structure in lignin. The reduction of quinones and quinone methides by sulphite results in the production of phenols that are more difficult to oxidize. The addition of sulphite also causes the reduction of transition metal ions to their lower valency states making them less harmful in the darkening process. Moreover, sulphite reduces the amount of dissolved oxygen in the pulp suspension, which would otherwise be involved in auto-oxidation reactions to produce chromophores.

The present invention includes all the chemicals in the sulfur dioxide series, that is, sulphurous acid in its alkali metal salt form especially the sodium salt form, such as sodium sulphite, sodium bisulphite, sodium metabisulphite and the like. Their relative proportions are dependent on the pH level desired. Sodium sulphite has a pH of 9.8 at 1%, by weight, concentration; sodium bisulphite has a pH 4.5. A combination of sodium bisulphite with sodium sulphite in solution can yield a pH range of between 4.5–9.8. The pH of a sodium sulphite solution can also be adjusted to neutral/alkaline by the relative proportions of different sulphites or by using a pH buffer such as sodium bicarbonate, or by using an acid, such as phosphoric acid. The use of the buffers or acids can also limit the dissolution of calcium carbonate.

The invention is concerned with inhibiting darkening of mechanical pulps in a neutral or alkaline medium, and is thus essentially concerned with a non-acidic medium. On the other hand, slightly acidic media which are close to neutral may also exhibit darkening. The present invention is thus more especially concerned with suspensions having a pH of at least 6.5, typically 6.5 to 9 and more especially 7 to 9.

The cost-effectiveness of the present invention in preventing alkaline darkening depends on the type of reducing agent used. In order to increase the performance of sodium sulphite, chelating agents, such as ethylene diamine tetra-acetic acid (EDTA) and diethylene triamine penta-acetic acid (DTPA), may be added during treatment. The chelating agent decreases the consumption of sodium sulphite.

The addition of the sulphite or a mixture thereof does not require any adjustment to pulp consistency, temperature or residence time. Nor would it require a major modification of existing equipment or, the installation of new capital equipment. Thus, with the help of additional brightness-stabilising chemicals, paper can be successfully manufactured in neutral or mildly alkaline mechanical pulping processes using calcium carbonate filler without experiencing a darkening effect. Additional benefits include a possible reduction of paper machine corrosion and the beneficial effect of bisulphite ions as biocides and enzyme inhibitors.

In the present invention, the term mechanical pulp refers to all lignin-containing pulp fibres including groundwood pulp, thermomechanical pulp, chemi-thermomechanical pulp, refiner mechanical pulp in bleached or unbleached form and in virgin or recycled form, and also to all papermaking furnishes containing such mechanical pulps. Alkaline darkening of mechanical pulp associated with the presence of calcium carbonate filler can be substantially reduced by adding sodium sulphite, a combination of sodium sulphite and sodium bisulphite, or a combination of sodium sulphite and sodium bicarbonate.

Other reducing agents which may be employed include sodium hydrosulphite and formamidine sulfinic acid.

The addition level of the sulphite or other reducing agent will depend on process conditions, i.e., pH, temperature, origin and type of mechanical pulp, and quality of process water. The reducing agent can be added at different points in the process after the refining stage, such as the latency chest, storage tank, or machine chest, before or together with the addition of $CaCO_3$.

EXAMPLES

The following examples help to more fully understand the method of the present invention and carry out the process. These examples should be taken as illustrative and are not meant to limit the scope of the invention.

Example I

Figure 1:
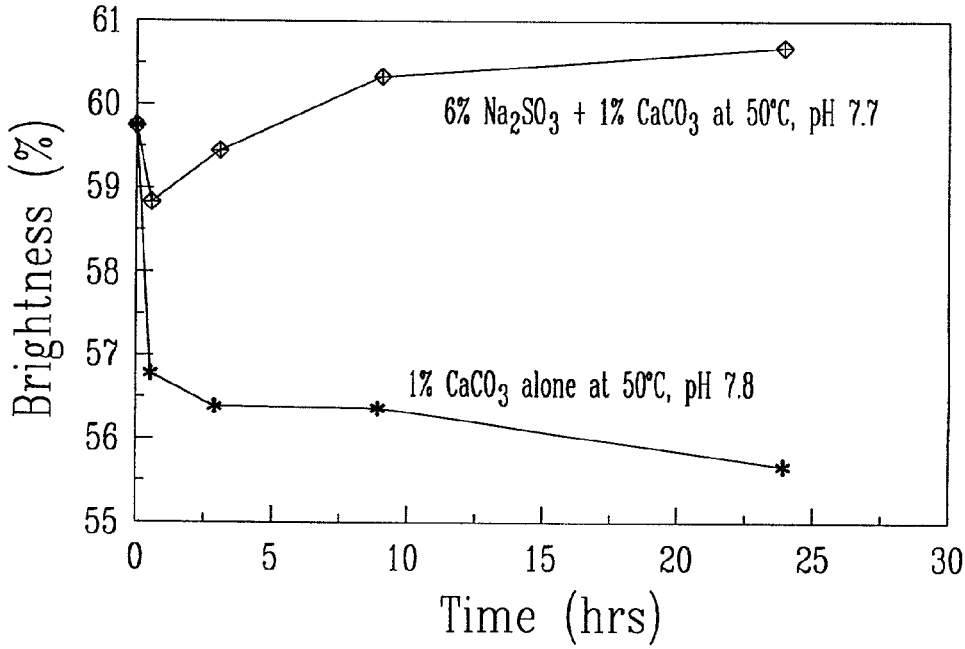
FIG. 1 is a graphical plot of pulp brightness with time for the invention and a prior art system.

This example was tailored to show how a commercial thermomechanical pulp (TMP) furnish blended with calcium carbonate filler can be successfully treated with sodium sulphite, according to the instant invention, to reduce darkening of the furnish. The TMP furnish, received from an Eastern Canadian pulp mill, was mixed with 1%, by weight, calcium carbonate filler. One part was treated with sodium sulphite while the other part was not. The results of the experiment, shown in FIG. 1, indicate that the sample without sodium sulfite began to darken immediately, losing three brightness points after 30 minutes at 50° C. The sulphite containing sample lost only one point of brightness in that period and thereafter, surprisingly, not only did it regain its starting brightness but surpassed it one additional point. The sample without sodium sulfite continued to darken in the subsequent time period losing a total of four brightness points.

Example II

An acid washed TMP furnish was slurried in water with 1.5% calcium carbonate (PCC) based on o.d. weight of furnish in the presence and absence of sodium sulphite. Prior to chemical addition, an acid washing was used to remove metal ions from TMP. The original brightness of the TMP furnish, as received from the mill, was 57.8%. The pH of the blend was adjusted to 7.5 with sodium phosphate. The results, shown in Table 1, indicate that the sample without sulphite darkened quickly losing a total of 6.2 brightness points while the sulphite-containing sample lost only two points.

TABLE 1

Acid washed TMP containing PCC treated with or without sodium sulphite.

| Sodium sulphite % | Treatment | Brightness, % | Scattering Coeff. $m^2/kg$ | Absorption Coeff $m^2/kg$ |
|---|---|---|---|---|
| 0 | as received | 57.80 | 50.48 | 2.34 |
| 0 | 1.5% PCC, pH 7.5, 75° C., 3 hrs | 51.56 | 50.62 | 4.53 |
| 2 | 1.5% PCC, pH 7.5, 75° C., 3 hrs | 55.75 | 49.90 | 3.31 |

Example III

Figure 2:
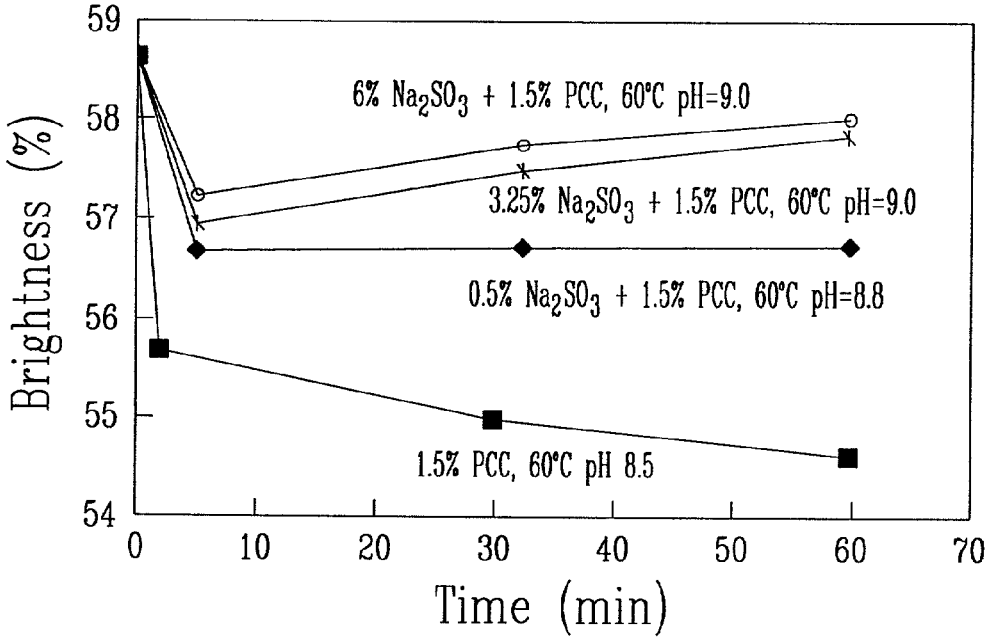
FIG. 2 is a further graphical plot of pulp brightness with time for different systems of the invention, and the prior art.

The effect of sodium sulphite dosage on the ability to prevent alkaline darkening of a commercial TMP furnish mixed with calcium carbonate filler (PCC) at high pH levels is demonstrated at 60° C. and in short time. As shown in FIG. 2, the TMP furnish with PCC and no added sulphite resulted in an increased pH, to 8.5 and, a rapid darkening of the pulp. When PCC and sodium sulphite were added to the furnish the pH increased to about 9, and darkening was reduced even at a low dosage of sodium sulphite (0.5%, by weight). Increasing the dosage of sodium sulphite to 6%, by weight, resulted in substantially less brightness loss.

Figure 3:
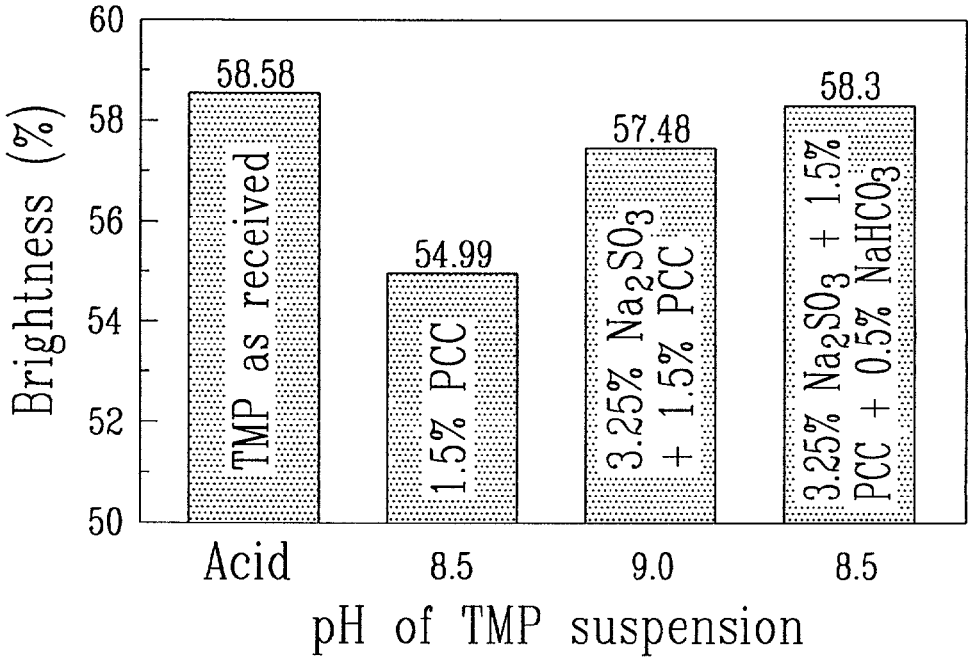
FIG. 3 demonstrates brightness results for different systems of the invention and the prior art.

FIG. 3 shows that when a mixture of sodium sulphite, sodium bicarbonate buffer, and calcium carbonate was added to the pulp furnish the pH decreased from 9.0 to 8.5, and consequently pulp darkening at short reaction time (30 min) was much lower than that without the pH buffer present. Since the addition of sodium sulphite alone increases the pH of pulp suspension more than the addition of calcium carbonate, a pH buffer like sodium bicarbonate, or a mixture of sodium sulphite and sodium bisulphite can be beneficially added to reduce the pH and the pulp darkening effect.

Example IV

Figure 4:
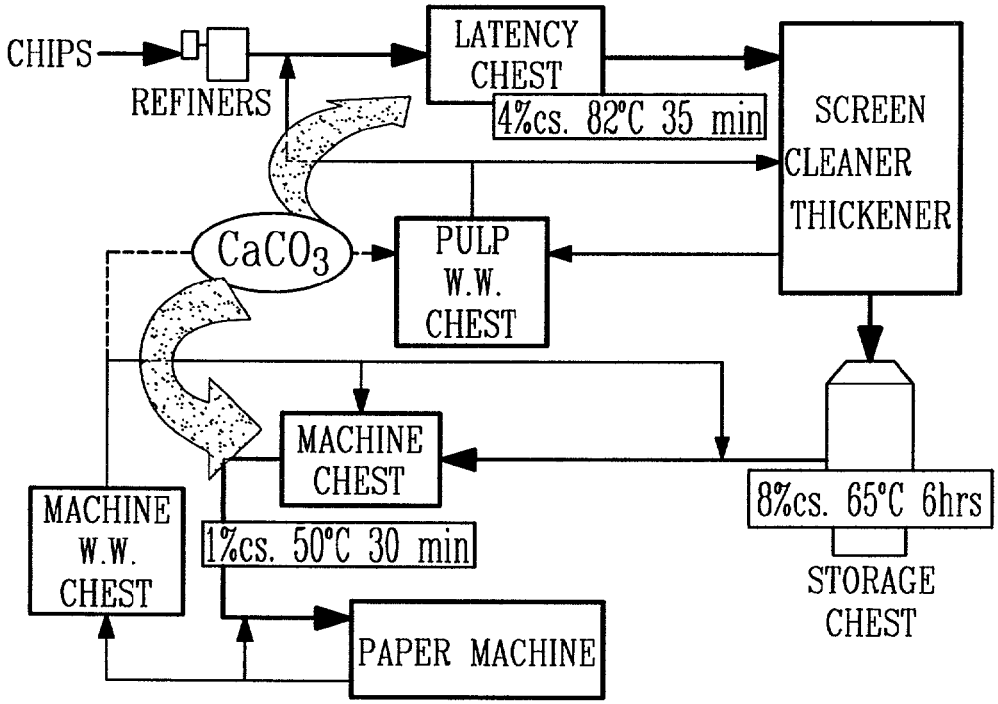
FIG. 4 illustrates schematically the circulation of $CaCO_3$-containing white water in a papermaking production line.

In a series of experiments the effect of calcium carbonate (PCC) addition and, retention time at various temperatures on the brightness of TMP furnish was demonstrated. The treatment was conducted at three pulp consistencies with and without sodium sulphite addition. The TMP furnish, at 8% consistency, was treated for 6 hrs at 65° C. (step 1), then diluted to 4% consistency and treated for 35 min at 82° C. (step 2), then diluted again to 1% consistency and treated for an additional 30 min at 50° C. (step 3). At the end of step 3 handsheets were prepared and brightness was measured. These steps simulate the effect of calcium carbonate and sodium sulphite addition in an integrated newsprint mill at various points from the latency chest to the head box of a paper machine (FIG. 4).

The control pulp used as received without any treatment had a brightness of 59.7%. The results shown in Table 2 indicate that, in the absence of sodium sulphite and calcium carbonate the pH of the pulp suspension was 6.0 and the brightness was reduced to 58.3% at the end of step 3 due to heat alone. When calcium carbonate was added to the TMP suspension at step 1, the pH immediately went alkaline, pH 8.1 and, at step 2 the pH was 7.6. At step 3 where more PCC was added the pH increased to 8.8. The pH of the sample that was treated with sodium sulphite was adjusted to similar pH levels, i.e., 7.9 at step 1, 8.0 at step 2 and 8.7 at step 3, by varying the proportions of sodium sulphite and sodium bisulphite. With the addition of sodium sulphite, pulp brightness was not affected, whereas there was a 6-point loss in brightness when no sodium sulphite was added.

It should be noted that the sodium sulphite charge used in this example does not represent real chemical consumption. The sulphite consumption is usually much lower than the amount charged. In the application of the method of the invention in a pulp or papermaking process the unreacted portion of sodium sulphite circulating in white water can be reused, which means that the total consumption of sodium sulphite would be much smaller.

TABLE 2

Sheet brightness after TMP treatment with PCC and sodium sulphite during the three steps that simulate a newsprint mill from latency chest to head box (see FIG. 4).

| Step 1 8% cs. 65° C. 6 hrs ⟹ | Step 2 4% cs. 82° C. 35 min ⟹ | Step 3 1% cs. 50° C. 30 min | Brightness (%) |
|---|---|---|---|
| Reference pH 6.0 | pH 5.7 | pH 5.7 | 58.3 |
| 1.5% PCC, pH 8.1 | pH 7.6 | 1% PCC, pH 8.8 | 53.8 |
| 1.5% PCC + 4% $Na_2SO_3$, pH 7.9 | pH 8.0 | 1% PCC, pH 8.7 | 59.6 |

The brightness of TMP as received was 59.7

Example V

TMP bleaching with sodium hydrosulphite is preferably carried out at a pH between 4 and 6. The bleaching efficiency decreases as the pH increases to neutral/alkaline. With the addition of calcium carbonate as a filler, the system pH loses its acidity and rapidly becomes alkaline thereby decreasing the bleaching efficiency due to alkali darkening.

The data in Table 3 shows TMP brightness after sodium hydrosulphite bleaching at pH 5.5 and 7.0, with and without sodium sulphite addition. The TMP furnish, collected after a disc filter had a brightness of 52.0%. The pulp furnish, at 4% consistency, was mixed at 85° C. for 2 hours, simulating storage in a latency chest followed by bleaching with 0.6% sodium hydrosulphite. The brightness of TMP bleached at pH 5.5 was 57.6%. TMP bleached with 0.6% sodium hydrosulphite, at pH 7.0 with no addition of sulphite, had a brightness of 54.6% a loss of 3 points in brightness. However, when the TMP furnish was pre-treated with 1% sodium sulphite, prior to hydrosulfite bleaching at pH 7.0, the brightness returned to 57.5%. This result indicates that sodium sulphite pre-treatment of TMP furnish compensates for the brightness loss associated with the poor performance of sodium hydrosulphite brightening at neutral pH conditions.

TABLE 3

The brightness of TMP bleached with hydrosulphite before and after a pre-treatment with sodium suiphite. The pH 7 was adjusted with sodium phosphate.

| Pretreatment 4% cs., 85° C., 2 hours | | Bleaching with 0.6% hydrosulphite at 3.7% cs., 60° C. for 40 min. | Handsheets |
|---|---|---|---|
| pH | $Na_2SO_3$ % | pH | Brightness % |
| No sodium sulphite pre-treatment or hydrosulphite bleaching | | | 52.0 |
| 5.3 | 0 | 5.5 | 57.6 |
| 7.0 | 0 | 7.0 | 54.6 |
| 7.0 | 0.5 | 7.0 | 56.8 |
| 7.0 | 1 | 7.0 | 57.5 |

Example VI

The effect of sodium sulphite on reducing mechanical pulp darkening was demonstrated in a mill trial. This mill produces speciality grades from hydrosulphite-bleached CTMP and calcium carbonate filler. It is important to note that at this CTMP mill sodium sulphite was being added to the preheaters before the refiners in order to soften the wood chip famish and reduce shive content. Analysis showed that there was no residual sodium sulphite present after the refining stage.

The mill experienced pulp darkening from the time it introduced the use of calcium carbonate filler. Not only did the pH in the paper machine system increase, but also the pH in the CTMP plant increased to neutral levels. This increase in pH caused a few point loss in pulp brightness because of alkali darkening.

Figure 5:
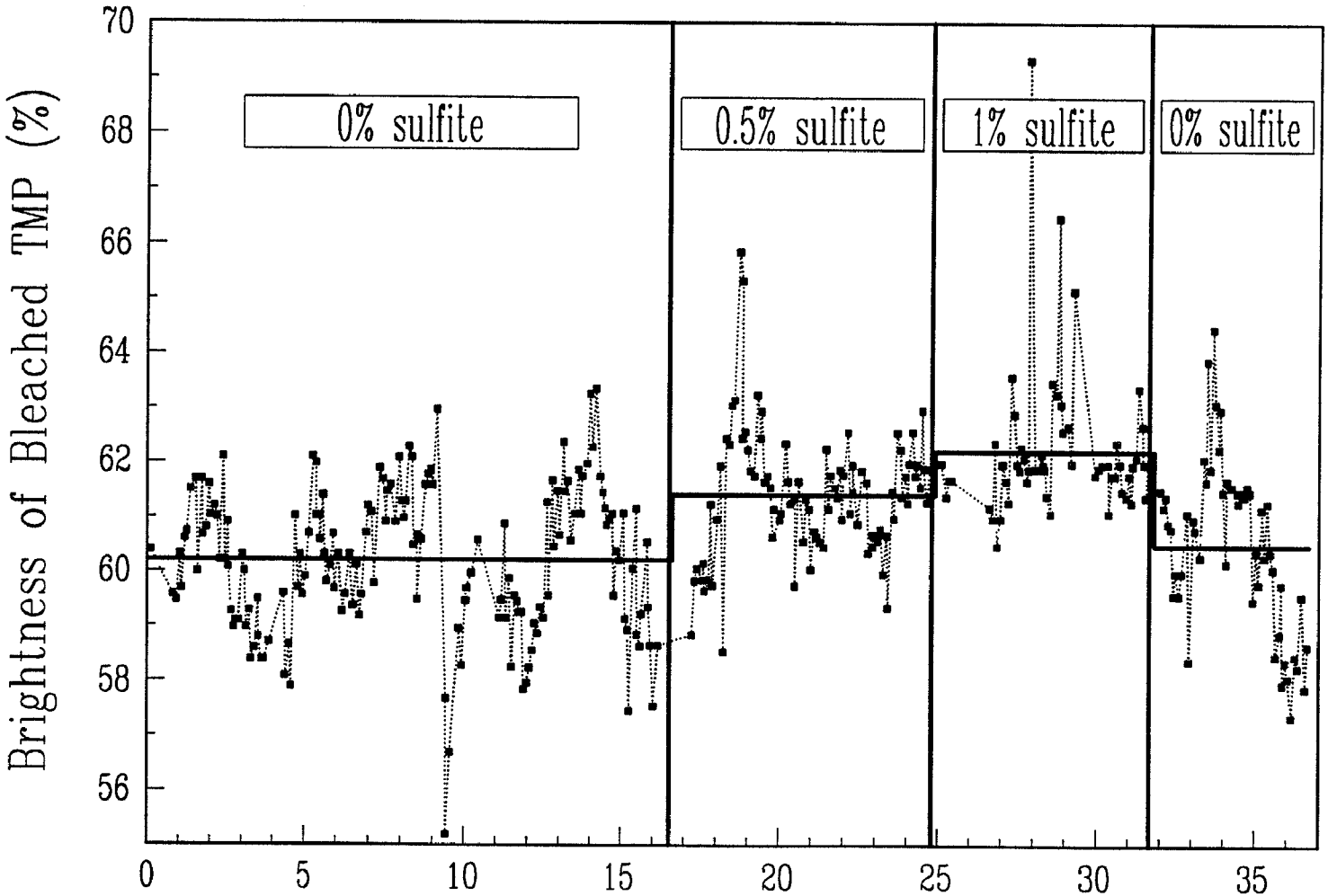
FIG. 5 illustrates graphically brightness results achieved for systems of the invention as compared with a prior system, in a mill trial.

To demonstrate the method of this invention in the mill trial, sodium sulphite was added to the latency chest at two dosage levels: 0.5% and 1%. The results in FIG. 5 show that the average brightness of the pulp before the addition of sodium sulphite was 60.1%, about 2–3 points lower than that during acidic papermaking. By adding 0.5% of sodium sulphite to the latency chest, the average pulp brightness increased to 61.5%. At the 1% dosage level, pulp brightness increased to 62.3%, close to that in acidic papermaking.

In order to ascertain the positive experience of reducing the alkali pulp darkening effect by the addition of sodium sulphite, the addition of sodium sulphite was terminated and pulp darkening quickly prevailed once again. Pulp brightness dropped to its previous level.

All % herein are to be understood to be %, by weight, unless otherwise indicated.

We claim:

1. A method of inhibiting alkaline darkening of a mechanical pulp in the presence of a calcium carbonate filler comprising:

providing an aqueous suspension of a mechanical pulp for producing paper, and incorporating in said suspension a calcium carbonate filler for producing paper with the pulp, and a sulphite to inhibit alkaline darkening of said pulp in said suspension arising from the calcium carbonate filler in the suspension, wherein said sulphite is incorporated together with said calcium carbonate filler in said suspension.

2. A method according to claim 1, wherein said sulphite is in an amount effective for inhibiting alkaline darkening.

3. A method according to claim 1, wherein a pH of at least 6.5 is established in the aqueous suspension of said pulp, containing the calcium carbonate filler and sulphite.

4. A method according to claim 3, wherein said sulphite is selected from alkali metal sulphites, alkali metal bisulphites and alkali metal metabisulphites.

5. A method according to claim 4, wherein said sulphite is selected from sodium sulphite, sodium bisulphite and sodium metabisulphite.

6. A method according to claim 5, wherein said pH is 6.5 to 9.

7. A method according to claim 6, wherein said pH is 7 to 9.

8. A method according to claim 6, wherein the pH is established by addition of a pH buffer or an acid.

9. A method according to claim 6, further including adding in chelating agent to the suspension.

10. A method according to claim 1, wherein the sulphite is incorporated in the suspension by addition at a latency chest, storage tank or machine chest during processing of the aqueous suspension to form paper.

11. A method of inhibiting darkening of a mechanical pulp in the presence of calcium carbonate comprising:

providing an aqueous suspension of a mechanical pulp for producing paper, incorporating in said suspension a calcium carbonate filler for producing paper with the pulp together with a sulphite, maintaining a pH of 7 to 9 in the resulting suspension containing said pulp, filler and sulphite, and chemically reacting said sulphite with said pulp to inhibit darkening of said pulp by said calcium carbonate.

12. A method according to claim 11, wherein said sulphite is selected from alkali metal sulphites, alkali metal bisulphites and alkali metal metabisulphites.

13. A method of producing paper from a mechanical pulp and calcium carbonate filler comprising:

providing an aqueous suspension of a mechanical pulp for producing paper, incorporating in said suspension a calcium carbonate filler for producing paper with the pulp, together with a sulphite, maintaining a pH of 6.5 to 9 in the resulting suspension containing said pulp, filler and sulphite, chemically reacting said sulphite with said pulp to inhibit darkening of said pulp by said calcium carbonate filler, and forming said suspension into paper.

14. A method according to claim 13, wherein said sulphite is selected from alkali metal sulphites, alkali metal bisulphites and alkali metal metabisulphite.

15. A method according to claim 13, wherein said sulphite is selected from sodium sulphite, sodium bisulphite and sodium metabisulphite.

* * * * *